US009412307B2

(12) United States Patent
Kwon et al.

(10) Patent No.: US 9,412,307 B2
(45) Date of Patent: Aug. 9, 2016

(54) ORGANIC LIGHT EMITTING DIODE DISPLAY AND DRIVING METHOD THEREOF

(71) Applicant: SAMSUNG DISPLAY CO., LTD., Yongin, Gyeonggi-Do (KR)

(72) Inventors: Sun-Ja Kwon, Yongin (KR); Jae-Sic Lee, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 0 days.

(21) Appl. No.: 14/219,551

(22) Filed: Mar. 19, 2014

(65) Prior Publication Data

US 2015/0002560 A1 Jan. 1, 2015

(30) Foreign Application Priority Data

Jun. 28, 2013 (KR) ..... 10-2013-0075570

(51) Int. Cl.
*G09G 3/30* (2006.01)
*G09G 3/32* (2016.01)

(52) U.S. Cl.
CPC ..... *G09G 3/3266* (2013.01); *G09G 2300/0842* (2013.01); *G09G 2310/021* (2013.01); *G09G 2320/045* (2013.01)

(58) Field of Classification Search
None
See application file for complete search history.

(56) References Cited

U.S. PATENT DOCUMENTS

2009/0160847 A1* 6/2009 Tanikame ..... G09G 3/3233 345/214
2011/0193855 A1* 8/2011 Han ..... G09G 3/3233 345/214
2012/0050234 A1* 3/2012 Jang ..... G09G 3/3225 345/204

FOREIGN PATENT DOCUMENTS

KR 10-2007-0082639 A 8/2007
KR 10-2010-0004635 A 1/2010
KR 10-2012-0019227 A 3/2012

* cited by examiner

*Primary Examiner* — Joseph Haley
*Assistant Examiner* — Ifedayo Iluyomade
(74) *Attorney, Agent, or Firm* — Lee & Morse, P.C.

(57) ABSTRACT

An organic light emitting diode (OLED) display includes a display unit including a plurality of pixels connected to a plurality of data lines, a plurality of scan lines, a plurality of initializing control lines, and a plurality of light emission control lines, a scan driver to output scan signals to the scan lines and initializing signals to the initializing control lines, and a data driver to output data signals to respective ones of the data lines. A first pixel and a second pixel may be commonly connected to a scan line and a data line. The scan driver may output at least one first initializing signal and at least one second initializing signal to the first pixel and second pixel, respectively. The scan signals and the first and the second initializing signals may be activated at different points in time.

17 Claims, 8 Drawing Sheets

ORGANIC LIGHT EMITTING DIODE DISPLAY AND DRIVING METHOD THEREOF

CROSS-REFERENCE TO RELATED APPLICATION

Korean Patent Application No. 10-2013-0075570, filed on Jun. 28, 2013, and entitled "Organic Light Emitting Diode Display and Driving Method Thereof," is incorporated by reference herein in its entirety.

BACKGROUND

1. Field

One or more embodiments described herein relate to a display device.

2. Description of the Related Art

Display devices have been used in a variety of applications. For example, display devices are used monitors for personal computers, and also are used to display images in portable information terminals such as portable phones, personal digital assistants (PDAs).

Examples of display devices include liquid crystal displays (LCDs), organic light emitting diode (OLED) displays, and plasma display panels (PDPs). Among these, the organic light emitting diode (OLED) display has proven to have excellent luminous efficiency, luminance and viewing angle, and a fast response speed.

SUMMARY

Embodiments are directed to an organic light emitting diode (OLED) display, including a display unit including a plurality of pixels connected to a plurality of data lines, a plurality of scan lines, a plurality of initializing control lines, and a plurality of light emission control lines, a scan driver to output scan signals to the scan lines and initializing signals to the initializing control lines, and a data driver to output data signals to respective ones of the data lines. A first pixel and a second pixel may be commonly connected to a scan line and a data line. The scan driver may output at least one first initializing signal and at least one second initializing signal to the first pixel and second pixel, respectively. The scan signals and the first and the second initializing signals may be activated at different points in time.

The scan driver may include a plurality of first stages to shift one of a frame start signal or an output signal of a previous first stage to output corresponding first initializing signals, a plurality of second stages to shift the first initializing signals to output second initializing signals, and a plurality of the third stages to shift the second initializing signals to output the scan signals.

A frame to drive the display may include a first subfield and a second subfield, and the data driver may output the data signal corresponding to the first pixel during the first subfield and output the data signal corresponding to the second pixel during the second subfield.

The display may further include a light emission control driver to output a first light emission control signal to a first light emission control line, a second light emission control signal to a second light emission control line, and a third light emission control signal to a third light emission control line. The first pixel may emit light according to the first light emission control signal and the second light emission control signal, and the second pixel may emit light according to the first light emission control signal and the third light emission control signal.

Each of the first and second pixels may include a driving transistor including a source electrode connected to a first node, a gate electrode connected to a second node, and a drain electrode connected to a third node, a switching transistor including a first electrode connected to a corresponding data line, a second electrode connected to the first node, and a gate electrode connected to a corresponding scan line, an initializing transistor including a first electrode connected to the second node, a second electrode to receive an initializing voltage, and a gate electrode connected to one of a first or second initializing control line, a selecting transistor a first electrode connected to the third node, a second electrode connected to an anode of the OLED, and a gate electrode connected to one of a second or third light emission control line, a light emission control transistor including a first electrode to receive a first power source voltage, a second electrode connected to the first node, and a gate electrode connected to the first light emission control line, and a capacitor including a first electrode to receive the first power source voltage and a second electrode connected to the second node, wherein the cathode of the OLED is connected to the second power source voltage.

Each of the first and the second pixels may include a threshold voltage compensation transistor including a first electrode connected to the second node, a second electrode connected to the third node, and a gate electrode connected to a corresponding scan line.

The scan driver may include an initializing driving block including a plurality of first initializing stages to shift one of a first frame start signal or an output signal of a previous first stage to output the first initializing signal, and a plurality of second initializing stages alternately disposed with the first initializing stages to shift the first initializing signal to output corresponding second initializing signals, and a scan driving block including a plurality of scan stages to shift one of a second frame start signal or an output signal of a previous second stage to output the plurality of scan signals. The second frame start signal may be activated at a different point in time from the first frame start signal.

Embodiments are also directed to a method for driving an organic light emitting diode (OLED) display, the method including transmitting a first initializing signal to a first pixel, transmitting a second initializing signal to the first pixel and a second pixel commonly connected to a scan line and a data line, and transmitting a data signal to each of the first and second pixels according to a scan signal. The scan signal and the first and the second initializing signals may be activated at a different point in time.

The transmitting the first initializing signal may include shifting a frame start signal or an output signal of a previous stage to output the first initializing signal.

Transmitting the second initializing signal may include shifting the first initializing signal to output the second initializing signal.

The method may further include shifting the second initializing signal to output the scan signal.

A frame may include first and the second subfields, and transmitting the data signal may include outputting the data signal to the first pixel during the first subfield and outputting the data signal to the second pixel during the second subfield.

Transmitting the data signal may further include emitting light from the first pixel according to a first light emission control signal transmitted to a first light emission control line and a second light emission control signal transmitted to a second light emission control line during the first subfield, and emitting light from the second pixel according to the first light emission control signal and a third light emission control signal transmitted to a third light emission control line during the second subfield.

Transmitting the first initializing signal may include shifting a first frame start signal or an output signal of a previous stage to output the first initializing signal.

The first initializing signal may further include shifting a second frame start signal activated at a different point in time from the first frame start signal or an output signal of a previous stage to output the scan signal.

Embodiments are also directed to a display device, including a first pixel, and a second pixel adjacent the first pixel. The first pixel may receive a first initializing signal and the second pixel may receive a second initializing signal. The first and second pixels may be commonly connected to a scan line to receive a scan signal and a data line to receive a data signal. The scan signal and the first and the second initializing signals may be received at different points in time, the first and second pixels emitting light based on light emission signals and the data signal.

The device may further include a scan driver to output the scan signal and the first and second initializing signals.

The first pixel may emit light based on a first light emission control signal and a second light emission control signal, and the second pixel may emit light based on a first light emission control signal and a third light emission control signal.

The first pixel may receive the data signal during a first subfield, the second pixel may receive the data signal during a second subfield, and the first and second subfields may be included in a same frame.

The scan signal may not overlap the first and second initializing signals.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
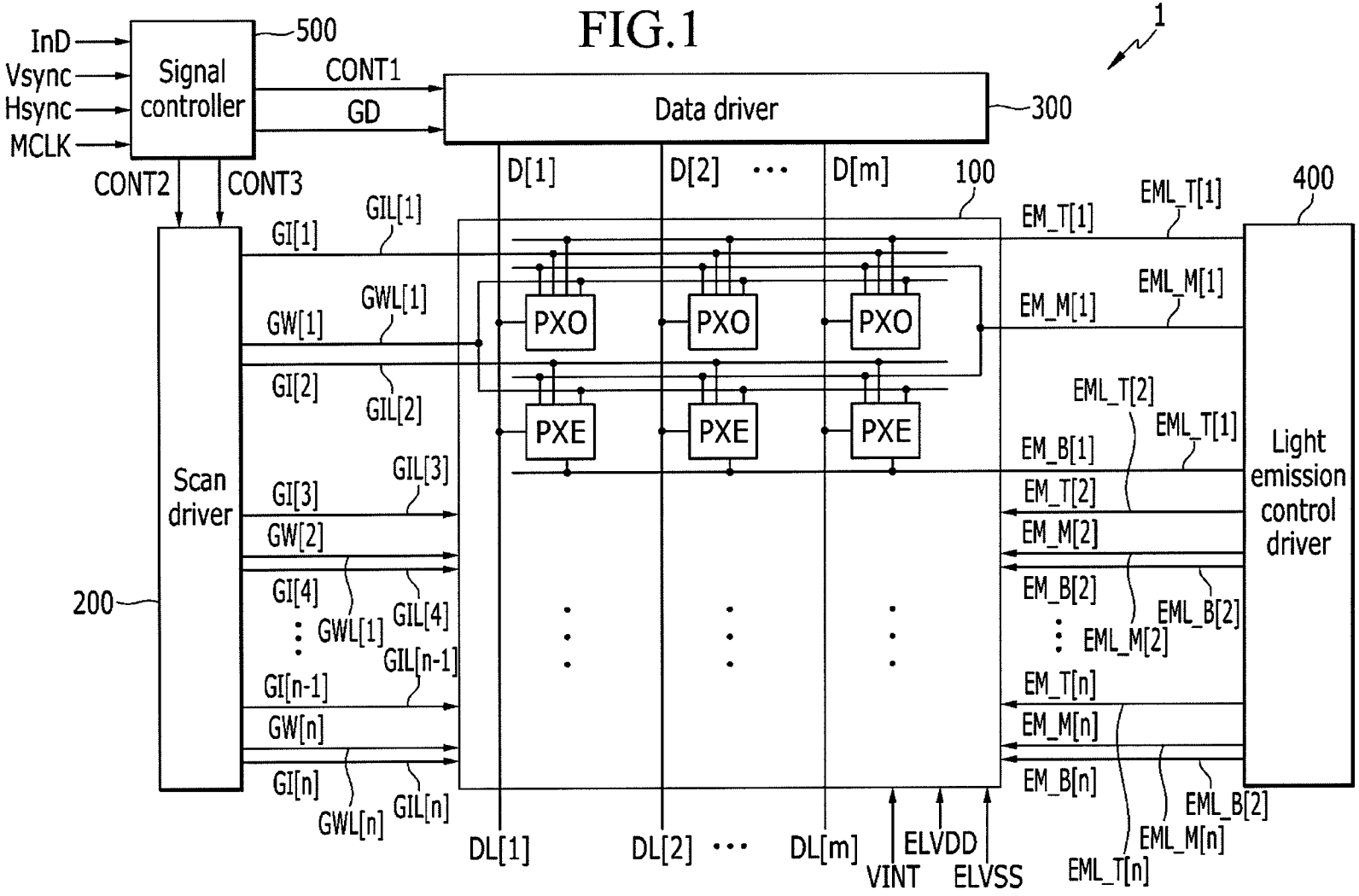
FIG. 1 illustrates an embodiment of an OLED display.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawing figures, the dimensions of layers and regions may be exaggerated for clarity of illustration. Like reference numerals refer to like elements throughout.

When it is described that an element is "coupled" to another element, this case includes a case in which the parts are "directly connected" with each other and a case in which the parts are "electrically connected" with each other with other elements interposed therebetween.

FIG. 1 illustrates an embodiment of an organic light emitting diode (OLED) display 1 which includes a display unit 100, a scan driver 200, a data driver 300, a light emission control driver 400, and a signal controller 500.

The display unit 100 includes a plurality of pixels (PX) in a display area. The display unit 100 also includes or is coupled to a plurality of scan lines GWL[1]-GWL[n], a plurality of initializing control lines GIL[1]-GIL[n], a plurality of data lines DL[1]-DL[m], a plurality of first light emission control lines EML_M[1]-EML_M[n], a plurality of second light emission control lines EML_T[1]-EML_T[n], and a plurality of third light emission control lines EML_B[1]-EML_B[n].

Each of the pixels PX includes at least two of an even pixel PXE and an odd pixel PXO which are arranged to be adjacent to one another in a column direction. Adjacent pairs of the even and odd pixels PXE and PXO are commonly connected to a corresponding scan line among the plurality of scan lines GWL[1]-GWL[n], and also to a corresponding first light emission control line among the plurality of the first light emission control lines EML_M[1]-EML_M[n].

Each of the odd pixels PXO is connected to a corresponding odd numbered initializing control line among the plurality of initializing control lines GIL[1]-GIL[n], and to a corresponding second light emission control line among the plurality of the second light emission control lines EML_T[1]-EML_T[n].

In addition, each of the even pixels PXE is connected to a corresponding odd numbered initializing control line among the plurality of initializing control lines GIL[1]-GIL[s], and to a corresponding third light emission control line among the plurality of the third light emission control lines EML_B[1]-EML_B[n].

Also, each of the odd and even pixels PXO and PXE receives first and second power source voltages ELVDD and ELVSS and an initialize voltage VINT. The odd and even pixels PXO and PXE in a same column are connected to the same data line among the plurality of data lines DL[1]-DL[m] and may emit light of the same color. For example, it is possible to emit light of any one of red, green, blue, or another color.

The scan driver 200 is controlled by a scan driving control signal CONT1 and an initializing driving control signal CONT2 The scan driver is connected to the plurality of scan lines GWL[1]-GWL[n] and the plurality of initializing control lines GIL[1]-GIL[n]. A more detailed description of scan driver 200 is provided with reference to FIG. 4.

The data driver 300 performs processing operations that are appropriate for characteristics of the display unit 100. For example, the data driver 300 processes and/or supplies an image data RGB according to a data driving control signal CONT3 to generate data signals for a plurality of data lines DL[1]-DL[m]. The data driver 300 transmits data signals D[1]-D[m] to the display unit through corresponding to data lines DL[1]-DL[m]. In doing so, the data driver 300 may divide a single frame into at least two subfields, and then may transmit a data signal for each of the odd and even pixels PXO and PXE to the corresponding data line during each subfield.

The light emission control driver 400 generates a plurality of first light emission control signals EM_M[1]-EM_M[n], a plurality of the second light emission control signals EM_T[1]-EM_T[n], and a plurality of third light emission control signals EM_B[1]-EM_ B[n] according to a light emission control driving signal CONT4.

The light emission control driver 400 transmits the first light emission control signals EM_M[1]-EM_M[n] to the first light emission control lines EML_M[1]-EML_M[n]. The light emission control driver 400 transmits the second light emission control signals EM_T[1]-EM_T[n] to the second light emission control lines EML_T[1]-EML_T[n]. In addition, the light emission control driver 400 transmits the third light emission control signals EM_B[1]-EM_B[n] to the third light emission control lines EML_B[1]-EML_B[n].

The signal controller 500 receives external input data InD and a synchronizing signal input, and generates the scan driving control signal CONT1, the initializing driving control signal CONT2, the data driving control signal CONT3, the light emission control driving signal CONT4 and image data GD. The synchronization signal includes a horizontal synchronization signal Hsync, a vertical synchronization signal Vsync, and a main clock signal MCLK.

Figure 2:
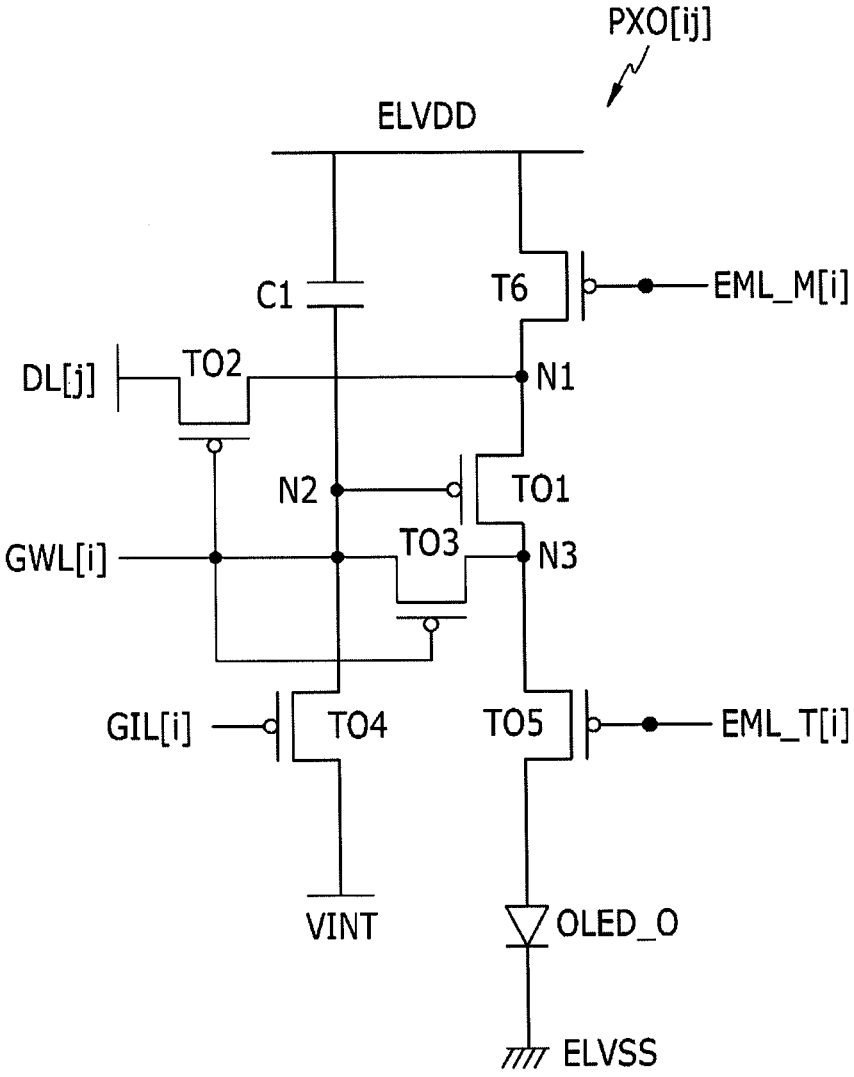
FIG. 2 illustrates an example of an odd pixel (PXO) in the display.

FIG. 2 illustrates an example of an odd pixel PXO[ij] connected to i-th scan line GWL[i] and j-th data line DL[j]. The odd pixel includes a driving transistor TO1, switching transistor TO2, a threshold voltage compensation transistor TO3, an initializing transistor TO4, a selecting transistor TO5, a light emission control transistor T6, a capacitor C1, and an organic light emitting diode OLED_O[ij].

The driving transistor TO1 includes a source electrode connected to the first node N1, a gate electrode connected to the second node N2 and a drain electrode connected to the third node N3. The driving transistor TO1 controls a driving current Id flowing to the third node N3 according to the voltage value applied to the gate electrode.

The switching transistor TO2 includes the first electrode connected to j-th data line DL[j], the second electrode connected to the first node N1, and the gate electrode connected to i-th scan line GWL[i]. The switching transistor TO2 is turned on according to the i-th the first scan signal GW[i] to transmit the data signal D[j] to the first node N1.

The threshold voltage compensation transistor TO3 includes the first electrode connected to the second node N2, the second electrode connected to the third node N3, and the gate electrode connected to the i-th scan line GWL[i]. The threshold voltage compensation transistor TO3 is turned on according to the i-th the first scan signal GW[i], to diode-connect the drain and gate electrodes of the driving transistor TO1.

The initializing transistor TO4 includes a first electrode connected to the second node N2, a second electrode to receive the initializing voltage VINT, and a gate electrode connected to the i−1-th initializing control line GIL[i−1].

The capacitor C1 includes an electrode to receive the first power source voltage ELVDD and another electrode connected to second node N2. The capacitor C1 stores a voltage value reflecting the threshold voltage Vth of the driving transistor TO1.

The selecting transistor TO5 includes a first electrode connected to the third node N3, a second electrode connected to the anode of the organic light emitting diode (OLED) OLED_O[ij], and a gate electrode connected to the i-th the second light emission control line EML_T[i]. A cathode of the organic light emitting diode (OLED) OLED_O[ij] receives the second driving voltage ELVSS.

The light emission control transistor T6 includes a first electrode that receives the first power source voltage ELVDD, a second electrode connected to the first node N1, and a gate electrode connected to the i-th first light emission control line EML_M[i].

Figure 3:
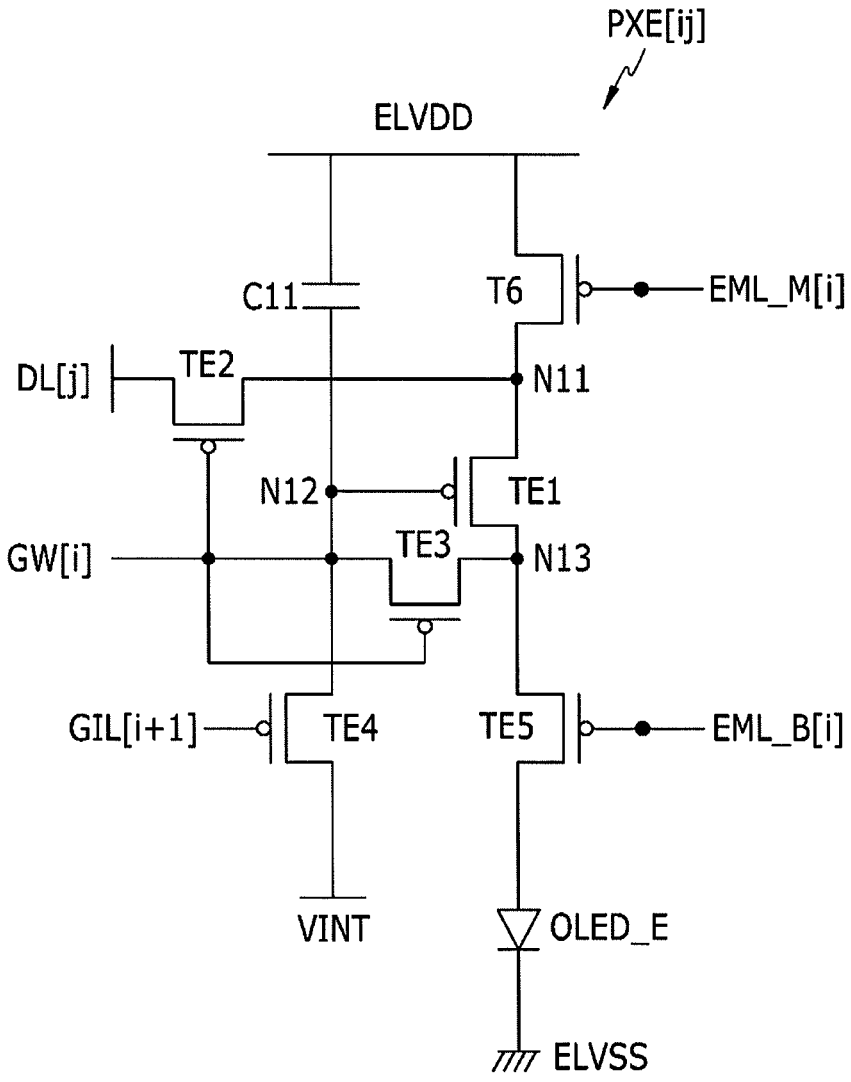
FIG. 3 illustrates an example of an even pixel (PXE) in the display.

FIG. 3 illustrates an example of an even pixel PXE[ij] connected to the i-th scan line GWL[i] and j-th data line DL[j]. The even pixel includes a driving transistor TE1, a switching transistor TE2, a threshold voltage compensation transistor TE3, an initializing transistor TE4, a selecting transistor TE5, a light emission control transistor T6, a capacitor C11, and an organic light emitting diode (OLED) OLED_E[ij].

Since the light emission control transistor T6 of the even pixel PXE[ij] is used in common with the light emission control transistor T6 of the odd pixel PXO[ij] in FIG. 2, the same reference numerals will be used for this feature.

The driving transistor TE1 includes a source electrode connected to a first node N11, a gate electrode connected to a second node N12, and a drain electrode connected to a third node N13. The switching transistor TE2 includes the first electrode connected to j-th data line DL[j], the second electrode connected to the first node N11, and the gate electrode connected to i-th scan line GWL[i].

The threshold voltage compensation transistor TE3 includes a first electrode connected to the second node N12, a second electrode connected to the third node N13, and a gate electrode connected to the i-th scan line GWL[i]. The initializing transistor TE4 includes a first electrode connected to the second node N12, a second electrode receiving the initializing voltage VINT, and a gate electrode connected to the i-th initializing control line GIL[i].

The capacitor C11 includes an electrode to receive the first power source voltage ELVDD and another electrode connected to second node N12. The selecting transistor TE5 includes a first electrode connected to the third node N13, a second electrode connected to the anode of the organic light emitting diode (OLED) OLED_E[ij], and a gate electrode connected to the i-th third light emission control line EML_B[i]. The cathode of the organic light emitting diode (OLED) OLED_E[ij] receives the second driving voltage ELVSS.

Figure 4:
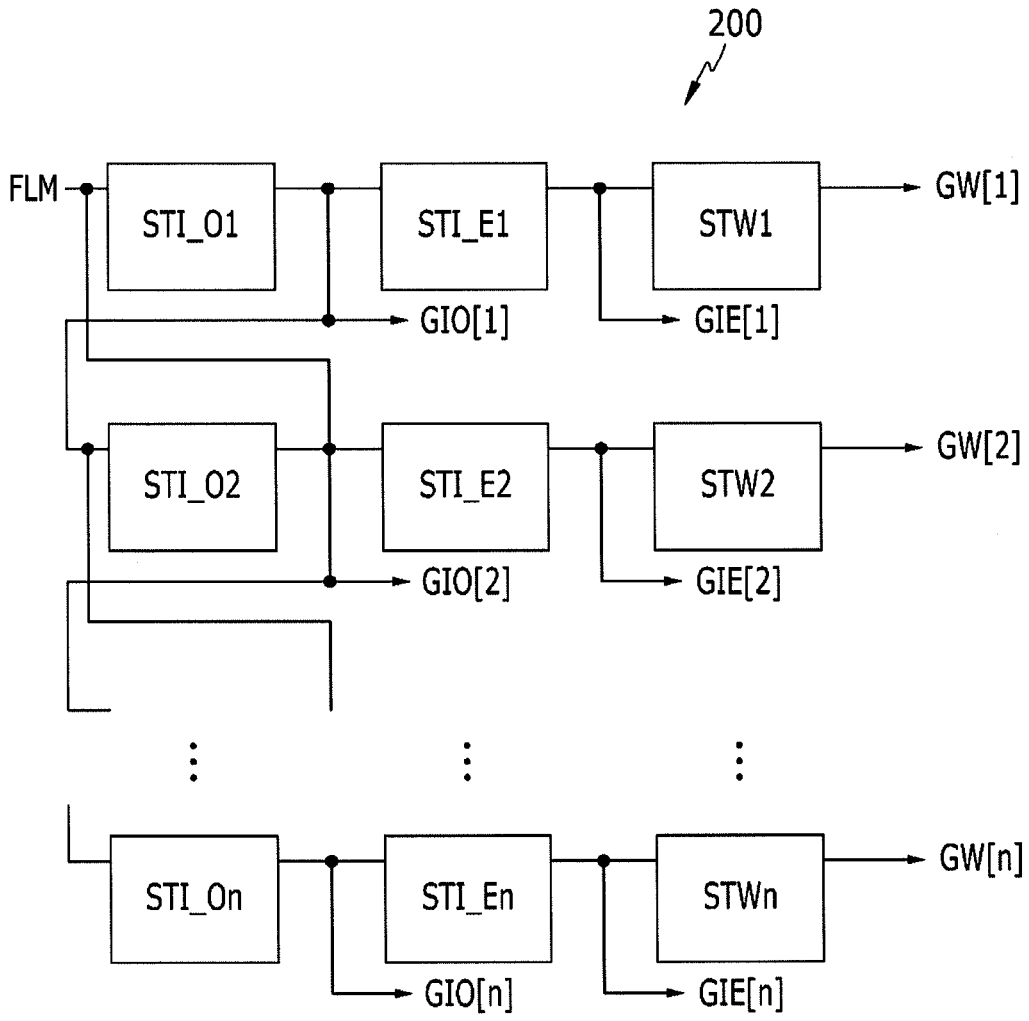
FIG. 4 illustrates an embodiment of a scan driver.

FIG. 4 illustrates one embodiment of scan driver 200 which includes a plurality of first stages STI_O1-STI_On, a plurality of second stages STI_E1-STI_En, and a plurality of the third stages STW1-STWn. Each of the first stages STI_O1-STI_On receives a frame start signal FLM or an odd initializing signal output from a previous stage, and performs a shift operation for a predetermined period to output a plurality of odd initializing signals GIO[1]-GIO[n]. In one embodiment, the predetermined period may be a first horizontal period. The first stages STI_O1-STI_On respectively transmit the odd initializing signals GIO[1]-GIO[n] to corresponding odd numbered initializing control lines, among the plurality of initializing control lines GIL[1]-GIL[n].

The plurality of second stages STI_E1-STI_En receives the plurality of odd initializing signal GIO[1]-GIO[n] output from corresponding ones of the first stages STI_O1-STI_On, and performs a shift operation for a predetermined period to output a plurality of even initializing signals GIE[1]-GIE[n]. The second stages STI_E1-STI_En transmit the even initializing signals GIE[1]-GIE[n] to corresponding even numbered initializing control lines, among the plurality of initializing control lines GIL[1]-GIL[n].

The third stages STW1-STWn receive respective ones of the even initializing signals GIE[1]-GIE[s] output from the second stages STI_E1-STI_En, and performs a shift operation for a predetermined period to output scan signals GW[1]-GW[n]. The third stages STW1-STWn transmit the scan signals GW[1]-GW[n] to corresponding scan lines GWL[1]-GWL[n].

Figure 5:
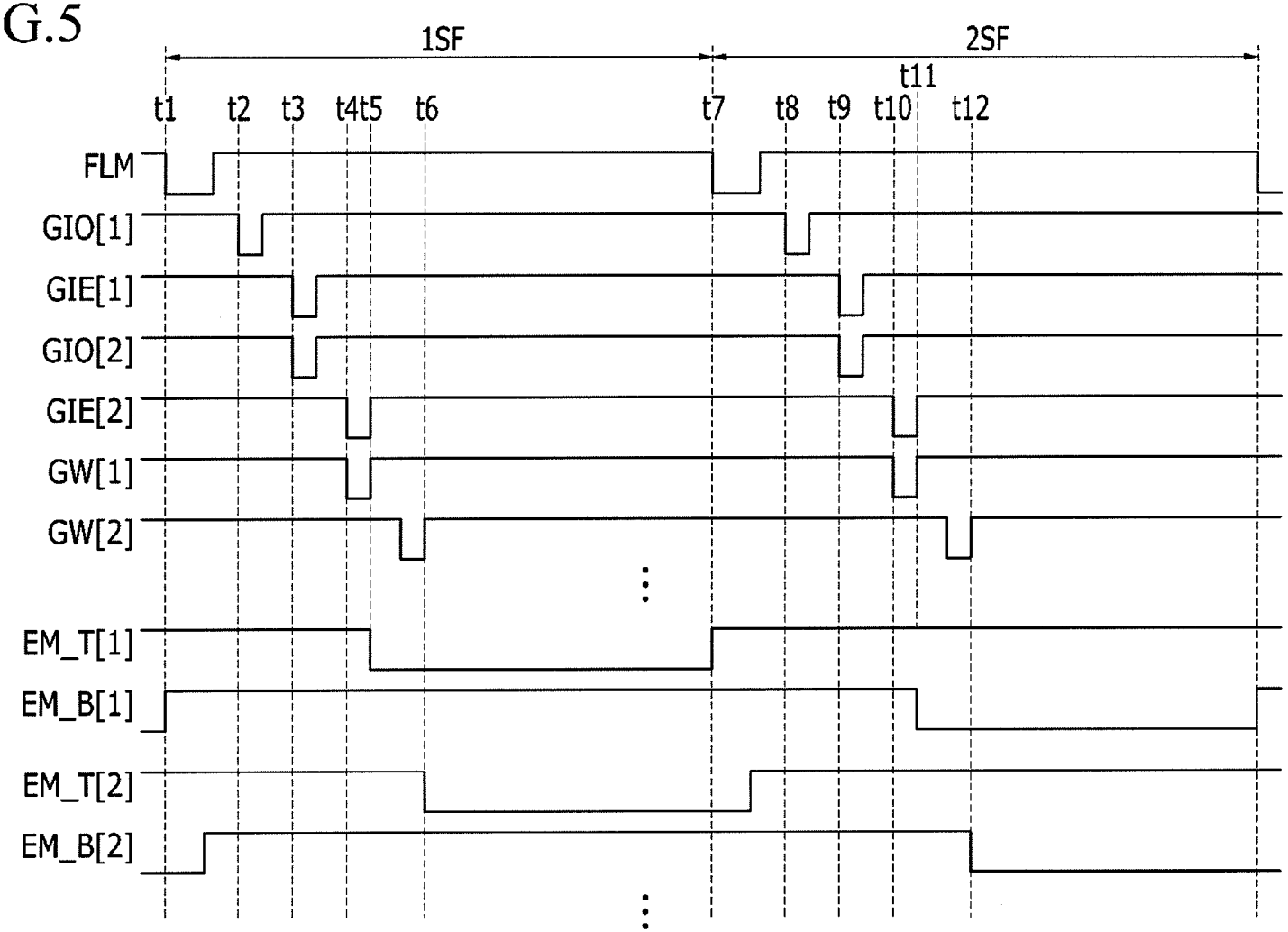
FIG. 5 illustrates a waveform corresponding to an embodiment of a driving method for an OLED display.

FIG. 5 illustrates an example of a waveform which may be used in a method to drive an organic light emitting diode (OLED) display, such as but not limited to the display described in FIGS. 1-4. Referring to FIG. 5, first, a single frame is divided into an odd subfield 1SF and an even subfield 2SF. A frame start signal FLM is activated to a low level at a point in time t1. Then, the first stage STI_O1 shifts the frame start signal FLM for a predetermined period at a point in time t2, to output odd initializing signal GIO[1].

As a result, the initializing transistor TO4 of the odd pixel PXO is turned on and the initializing voltage VINT is sent to the second node N2. Therefore, a gate-source voltage difference of the driving transistor TO1 is maintained by the voltage difference between the first voltage ELVDD and initializing voltage VINT.

Next, the second stage STI_E1 shifts the first odd initializing signal GIO[1] for a predetermined period at a point in time t3, to output the first even initializing signal GIE[1]. Then, the third stage STW1 shifts the first even initializing signal GIE[1] for the predetermined period, at a point in time t4 to output the scan signal GW[1].

As a result, the switching transistor TO2 and the threshold voltage compensation transistor TO3 are turned-on, and the capacitor C1 stores the voltage value reflecting the threshold voltage Vth of the driving transistor TO1 to the voltage corresponding to the data signal D[1]. Each of the odd pixels PXO sequentially performs these initializing and data writing processes.

Next, the second light emission control signal EML_T[1] is activated at a point in time t5, to turn on the selecting transistor TO5. In this case, the first light emission control signal EML_M[1] is maintained in an active state. Accordingly, the organic light emitting diode OLED_O of the odd pixel PXO connected to first scan line SL[1] emits light. Then, the second light emission control signal EML_T[2] is activated at a point in time t6, such that the organic light emitting diode OLED_O of the odd pixel PXO connected to second scan line SL[2] emits light. As described above, the plurality of odd pixels PXO sequentially emit light.

Next, the frame start signal FLM is activated to the low level at time t7. Next, the first stage STI_O1 shifts the frame start signal FLM for a predetermined period at time t8 to output odd initializing signal GIO[1]. Next, the second stage STI_E1 shifts the first odd initializing signal GIO[1] for a predetermined period at time t9, to output the first even initializing signal GIE[1].

As a result, the initializing transistor TE4 of the even pixel PXE is turned-on and the initializing voltage VINT is sent to the second node N2. Therefore, a gate-source voltage difference of the driving transistor TE1 is maintained by the voltage difference between the first voltage ELVDD and the initializing voltage VINT.

Next, the third stage STW1 shifts the first even initializing signal GIE[1] for a predetermined period at time t10, to output scan signal GW[1]. As a result, the switching transistor TE2 and the threshold voltage compensation transistor TE3 are turned-on, and the capacitor C11 stores a voltage value reflecting the threshold voltage Vth of the driving transistor TE1 to the voltage corresponding to the data signal D[1]. Each of the odd pixels PXE sequentially performs these initializing and data writing processes.

Next, the third light emission control signal EM_B[1] is activated at time t11, to turn on the selecting transistor TE5. In this case, the first light emission control signal EML_M[1] is maintained in an active state. Accordingly, the organic light emitting diode OLED_E of the even pixel PXE connected to the first scan line SL[1] emits light.

Next, the third light emission control signal EM_B[2] is activated at time t12, such that the organic light emitting diode OLED_E of the even pixel PXE connected to second scan line SL[2] emits light. The plurality of even pixels PXE sequentially emit light in the above-described manner.

Figure 6:
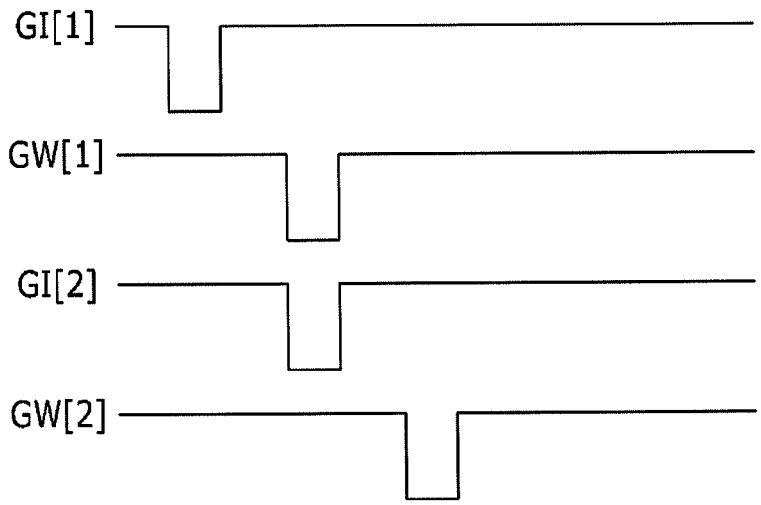
FIG. 6 illustrates a waveform corresponding to another type of driving method for an OLED display.

That is, the scan signal GW[1] does not overlap the first odd initializing signal GIO[1] and the first even initializing signal GIE[1]. On the contrary, in a case in which the number of the stage is set to two, the initializing signal GI[1] is shifted for a predetermined period as shown. As a result, the scan signal GW[1] is output as shown in FIG. 6. Simultaneously, the initializing signal GI[2] is output.

Therefore, after the odd pixel PXO is initialized by the initializing signal GI[1], the data signal D[1] is written by the scan signal GW[1]. However, since an activation time of the initializing signal GI [2] and the scan signal GW[1] overlap each other, the even pixel PXE may fail to normally initialize. According to the present embodiment, the initializing section and the data writing section for each of the odd pixel PXO and the even pixel PXE are separate from each other to enable performance of time-division control driving. This driving may be performed from the first to n scan lines GWL[1]-GWL[n] direction, or alternatively in the opposite direction.

Figure 7:
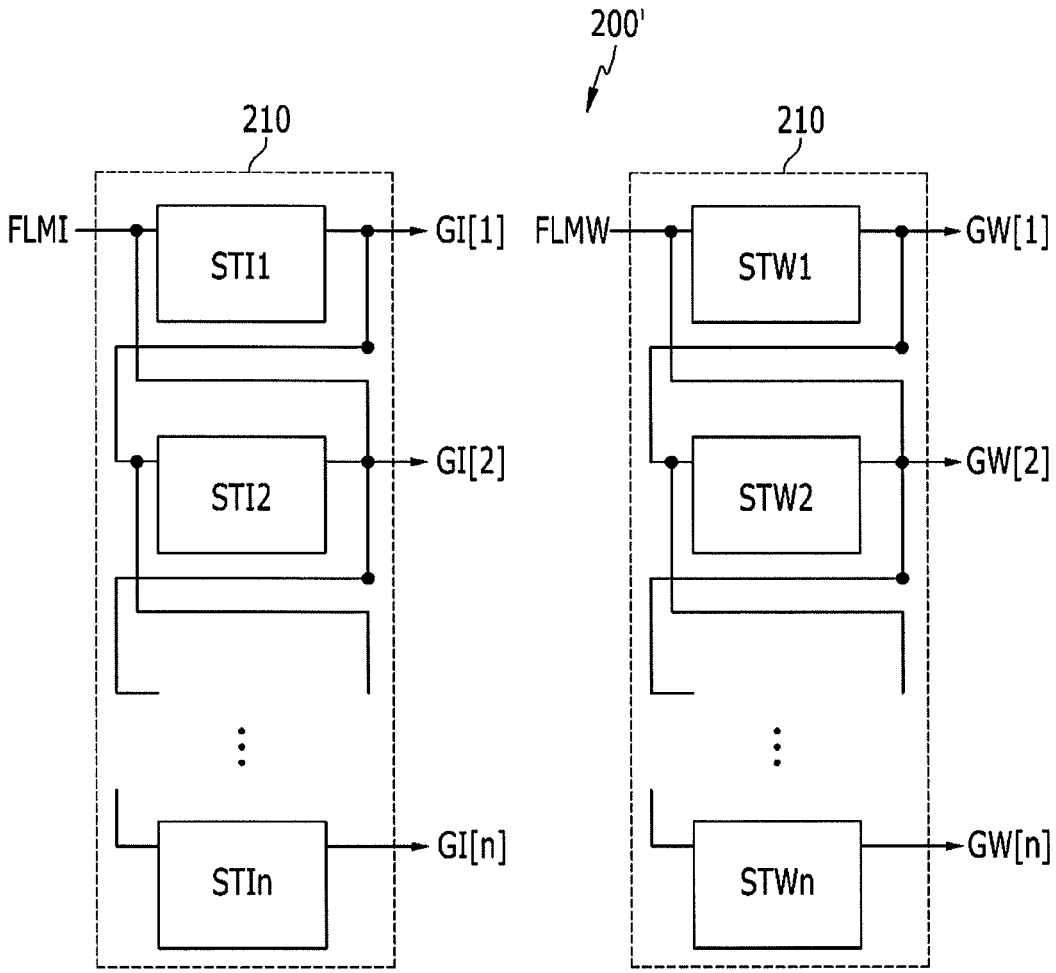
FIG. 7 illustrates another embodiment of a scan driver.

FIG. 7 illustrates another embodiment of a scan driver 200' which includes an initializing scan driving block 210 and a scan driving block 220. The initializing scan driving block 210 includes a plurality of initializing stages STI1-STIn. The initializing stages STI1-STIn receives the first frame start signal FLMI (e.g., STI1) or an initializing signal output from a previous initializing stage (e.g., STI2-STIn) and abd performs a shift operation for a predetermined period to output a plurality of initializing signals GI[1]-GI[n].

The scan driving block 220 includes a plurality of scan stages STW1-STWn. The scan stages STW1~STWn receive a second frame start signal FLMW (e.g., STW1) or an initializing signal output from previous scan stage (e.g., STW2-STWn) and performs a shift operation for a predetermined period, to output a plurality of scan signals GW[1]-GW[n].

Figure 8:
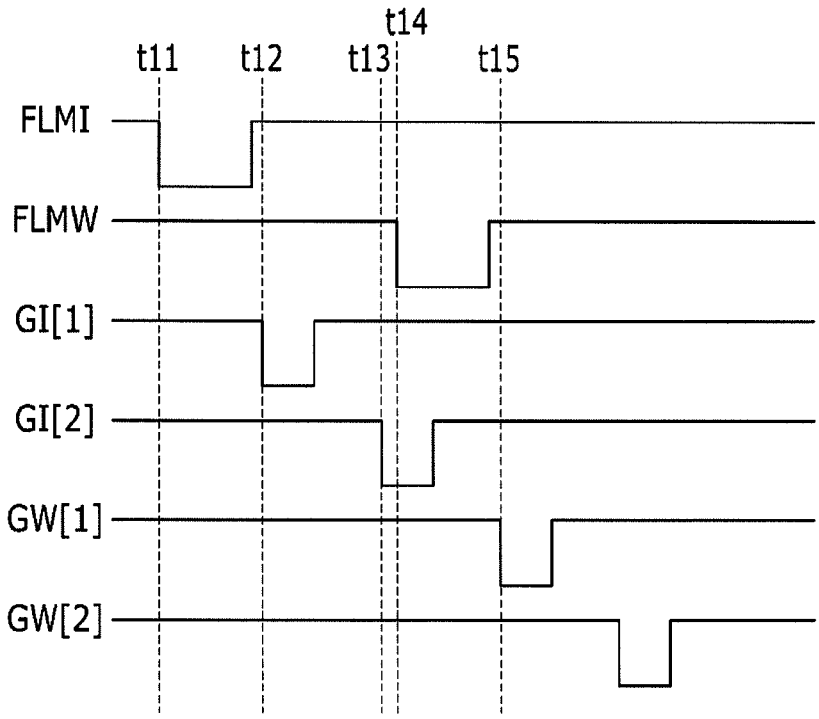
FIG. 8 illustrates a waveform corresponding to operation of the scan driver.

FIG. 8 illustrates a waveform diagram for driving scan driver 200' shown in FIG. 7. Referring to FIG. 8, first, the first frame start signal FLMI is activated to a low level at a point in time t11. Then, the first initializing stage STI1 shifts the frame start signal FLMI for the predetermined period at a point in time t12 to output the first initializing signal GI[1]. Next, the second initializing stage STI2 shifts the first initializing signal GI[1] for the predetermined period at a point in time t13 to output the second initializing signal GI[2].

Next, the second frame start signal FLMW is activated to the low level at time t14. Then, the scan stage STW1 shifts the second start signal FLMW for a predetermined period at time t15, to output the first scan signal GW[1]. Thus, the first scan signal GW[1] does not overlap the first initializing signal GI[1] and the second initializing signal GI[2].

By way of summation and review, a display device has a display area in which a plurality of pixels is disposed in matrix form. Images are generated by connecting a scan line and a data line to each of the pixels. Data signals are then selectively applied to each pixel. In OLED and other types of displays, each pixel may include a plurality of subpixels that emit light in different colors. For example, each pixel may include a subpixel emitting red (R) light, a subpixel emitting green (G) light, and a subpixel emitting blue (B) light. The color emitted from each pixel, therefore, represents a combination of the light emitted from its subpixels.

In order to drive the subpixels, a driving circuit, a data line transmitting a data signal, and a scan line transmitting a scan signal for each subpixel may be used, in which case many signal wires may be required which may make it difficult to form the pixels, especially for higher resolutions. In addition, an aperture ratio corresponding to the area in which the light is emitted in the pixel may be reduced.

As described above, embodiments may provide an organic light emitting diode (OLED) display capable of reducing a dead space by commonly using a portion of a driving circuit for driving a plurality of subpixels adjacent in a column direction and applying a time-divisional control scheme which sequentially emits the light in the plurality of subpixels by time-dividing a single frame into a plurality of subfields. Embodiments may also provide a driving method thereof. An embodiment may provide a driving method of the organic light emitting diode (OLED) display using a scan driving apparatus that separates an initializing section and a data writing section from each of a plurality of subpixels.

According an embodiment, an organic light emitting diode (OLED) display may commonly use a portion of a driving circuit for driving the plurality of subpixels adjacent in the column direction and apply a time-divisional control scheme to sequentially emits the light in the plurality of subpixels by time-dividing a single frame into the plurality of subfields. Embodiments may also provide a driving method thereof. According to embodiments, it may be possible to increase resolution and reduce a dead space.

In addition, the exemplary embodiment of the present invention separates an initializing section and a data writing section from each of a plurality of subpixels to remove luminance deviation, thereby making it possible to drive the display unit in both directions.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting diode (OLED) display, comprising: a display unit including a plurality of pixels connected to a plurality of data lines, a plurality of scan lines, a plurality of initializing control lines, and a plurality of light emission control lines; a scan driver to output scan signals to the scan lines and initializing signals to the initializing control lines; and a data driver to output data signals to respective ones of the data lines, wherein a first pixel and a second pixel are commonly connected to a first scan line and a first data line, wherein the scan driver outputs at least one first initializing signal and at least one second initializing signal to the first pixel and second pixel, respectively, wherein the scan signal is output to the first scan line, and the first and the second initializing signals are output at different points in time, the first and second initializing signals output before the scan signal is output to the first scan line, wherein a frame includes first and second subfields and wherein: a data signal is received by the first pixel during the first subfield, the data signal is received by the second pixel during the second subfield, the first pixel emits light according to a first light emission control signal received from a first light emission control line and a second light emission control signal received from a second light emission control line during the first subfield, and the second pixel emits light according to the first light emission control signal and a third light emission control signal received from a third light emission control line during the second subfield.

2. The display as claimed in claim 1, wherein the scan driver includes:

a plurality of first stages to shift one of a frame start signal or an output signal of a previous first stage to output corresponding first initializing signals;

a plurality of second stages to shift the first initializing signals to output second initializing signals; and a plurality of the third stages to shift the second initializing signals to output the scan signals.

3. An organic light emitting diode (OLED) The display as further comprising:

a display unit including a plurality of pixels connected to a plurality of data lines, a plurality of scan lines, a plurality of initializing control lines, and a plurality of light emission control lines;

a scan driver to output scan signals to the scan lines and initializing signals to the initializing control lines;

a data driver to output data signals to respective ones of the data lines, and a light emission control driver to output a first light emission control signal to a first light emission control line, a second light emission control signal to a second light emission control line, and a third light emission control signal to a third light emission control line, wherein:

a first pixel and a second pixel are commonly connected to a first scan line and a first data line, the scan driver outputs at least one first initializing signal and at least one second initializing signal to the first pixel and second pixel, respectively, the scan signal is output to the first scan line and the first and second initializing signals are output at different points in time, the first pixel emits light according to the first light emission control signal and the second light emission control signal, and the second pixel emits light according to the first light emission control signal and the third light emission control signal.

4. The display as claimed in claim 3, wherein each of the first and second pixels includes:

a driving transistor including a source electrode connected to a first node, a gate electrode connected to a second node, and a drain electrode connected to a third node;

a switching transistor including a first electrode connected to a corresponding data line, a second electrode connected to the first node, and a gate electrode connected to a corresponding scan line;

an initializing transistor including a first electrode connected to the second node, a second electrode to receive an initializing voltage, and a gate electrode connected to receive one of the first initializing control signal through a first initializing control line or the second initializing control signal through a second initializing control line;

a selecting transistor a first electrode connected to the third node, a second electrode connected to an anode of the OLED, and a gate electrode connected to one of a second or third light emission control line;

a light emission control transistor including a first electrode to receive a first power source voltage, a second electrode connected to the first node, and a gate electrode connected to the first light emission control line; and a capacitor including a first electrode to receive the first power source voltage and a second electrode connected to the second node, wherein the cathode of the OLED is connected to the second power source voltage.

5. The display as claimed in claim 4, wherein:

each of the first and the second pixels includes a threshold voltage compensation transistor including a first electrode connected to the second node, a second electrode connected to the third node, and a gate electrode connected to a corresponding scan line.

6. The display as claimed in claim 1, wherein the scan driver includes:

an initializing driving block including a plurality of first initializing stages to shift one of a first frame start signal or an output signal of a previous first stage to output the first initializing signal, and a plurality of second initializing stages alternately disposed with the first initializing stages to shift the first initializing signal to output corresponding second initializing signals; and a scan driving block including a plurality of scan stages to shift one of a second frame start signal or an output signal of a previous second stage to output the plurality of scan signals, wherein the second frame start signal is activated at a different point in time from the first frame start signal.

7. A method for driving an organic light emitting diode (OLED) display, the method comprising: transmitting a first initializing signal to a first pixel; transmitting a second initializing signal to a second pixel commonly connected to a scan line and a data line; and transmitting a data signal to each of the first and second pixels according to a scan signal, wherein the scan signal and the first and the second initializing signals are activated at different points in time, wherein a frame includes first and second subfields and wherein transmitting the data signal includes: outputting the data signal to the first pixel during the first subfield, outputting the data signal to the second pixel during the second subfield, emitting light from the first pixel according to a first light emission control signal transmitted to a first light emission control line and a second light emission control signal transmitted to a second light emission control line during the first subfield, and emitting light from the second pixel according to the first light emission control signal and a third light emission control signal transmitted to a third light emission control line during the second subfield.

8. The method as claimed in claim 7, wherein the transmitting the first initializing signal includes shifting a frame start signal or an output signal of a previous stage to output the first initializing signal.

9. The method as claimed in claim 7, wherein transmitting the second initializing signal includes shifting the first initializing signal to output the second initializing signal.

10. The method as claimed in claim 7, further comprising: shifting the second initializing signal to output the scan signal.

11. The method as claimed in claim 7, wherein transmitting the first initializing signal includes shifting a first frame start signal or an output signal of a previous stage to output the first initializing signal.

12. The method as claimed in claim 11, wherein transmitting the first initializing signal further includes shifting a second frame start signal activated at a different point in time from the first frame start signal or an output signal of a previous stage to output the scan signal.

13. A display device, comprising: a first pixel; and a second pixel adjacent the first pixel; wherein the first pixel receives a first initializing signal and the second pixel receives a second initializing signal, wherein the first and second pixels are commonly connected to a scan line to receive a scan signal and a data line to receive a data signal, wherein the scan signal and the first and the second initializing signals are received at different points in time, the first and second initializing signals received before the scan signal is received by the first scan line, the first and second pixels emitting light based on light emission signals and the data signal, wherein a frame includes first and second subfields and wherein: the data signal is received by the first pixel during the first subfield, the data signal is received by the second pixel during the second subfield, the first pixel emits light according to a first light emission control signal received from a first light emission control line and a second light emission control signal received from a second light emission control line during the first subfield, and the second pixel emits light according to the first light emission control signal and a third light emission control signal received from a third light emission control line during the second subfield.

14. The device as claimed in claim 13, further comprising:

a scan driver to output the scan signal and the first and second initializing signals.

15. An organic light emitting diode (OLED) display device, comprising: a first pixel; and a second pixel adjacent the first pixel; wherein the first pixel receives a first initializing signal and the second pixel receives a second initializing signal, wherein the first and second pixels are commonly connected to a scan line to receive a scan signal and a data line to receive a data signal, wherein the scan signal and the first and the second initializing signals are received at different points in time, the first and second pixels emitting light based on light emission signals and the data signal, and wherein the first pixel emits light based on a first light emission control signal and a second light emission control signal, and the second pixel emits light based on a first light emission control signal and a third light emission control signal.

16. The device as claimed in claim 13, wherein:

the first pixel receives the data signal during a first subfield;

the second pixel receives the data signal during a second subfield; and the first and second subfields are included in a same frame.

17. The device as claimed in claim 13, wherein the scan signal does not overlap the first and second initializing signals.

* * * * *